United States Patent [19]

Meininger et al.

[11] Patent Number: 4,581,163

[45] Date of Patent: Apr. 8, 1986

[54] METHOD FOR CONDITIONING WEAKLY TO MEDIUM-ACTIVE WASTES

[75] Inventors: Siegfried Meininger, Offenbach; Dietmar Bege, Erlangen; Karl Friesner, Strullendorf, all of Fed. Rep. of Germany

[73] Assignee: Kraftwerk Union Aktiengesellschaft, Mulheim, Fed. Rep. of Germany

[21] Appl. No.: 463,913

[22] Filed: Feb. 4, 1983

[30] Foreign Application Priority Data

Feb. 8, 1982 [DE] Fed. Rep. of Germany ..... 3204204

[51] Int. Cl.[4] ..... G21F 9/34

[52] U.S. Cl. ..... 252/633; 252/626; 219/72

[58] Field of Search ..... 252/628, 629, 632, 626, 252/633; 241/DIG. 38; 219/72, 73, 117.1, 119, 120, 121 PA, 121 PB

[56] References Cited

U.S. PATENT DOCUMENTS

| | | | |
|---|---|---|---|
| 3,971,671 | 7/1976 | Duperray et al. | 136/86 R |
| 3,983,050 | 9/1976 | Mecham | 252/633 |
| 4,326,842 | 4/1982 | Adachi et al. | 252/626 |
| 4,328,423 | 5/1982 | Lorenzo et al. | 252/633 |
| 4,366,095 | 12/1982 | Takats et al. | 252/633 |
| 4,376,598 | 3/1983 | Brouns et al. | 405/258 |

FOREIGN PATENT DOCUMENTS

| | | | |
|---|---|---|---|
| 3002697 | 8/1980 | Fed. Rep. of Germany | 252/626 |
| 3002695 | 8/1980 | Fed. Rep. of Germany | 252/626 |

*Primary Examiner*—Stephen J. Lechert, Jr.
*Assistant Examiner*—Howard J. Locker
*Attorney, Agent, or Firm*—Herbert L. Lerner; Laurence A. Greenberg

[57] ABSTRACT

Method and apparatus for conditioning weakly to medium-active wastes through fused vitrification by means of electric electrodes for generating the melting heat. The wastes optionally with additive materials are filled into a cup-shaped melting crucible which contains at least two electrodes. The melting crucible is closed off at the top by a furnace hood which has current leads. Voltage is applied to the electrodes via the current leads until the melting crucible containing material to be melted has melted. The current leads are separated from the electrodes. The furnace hood is removed, and after the cooling down, the melting crucible is filled with inactive cement paste to produce a cover layer.

14 Claims, 1 Drawing Figure

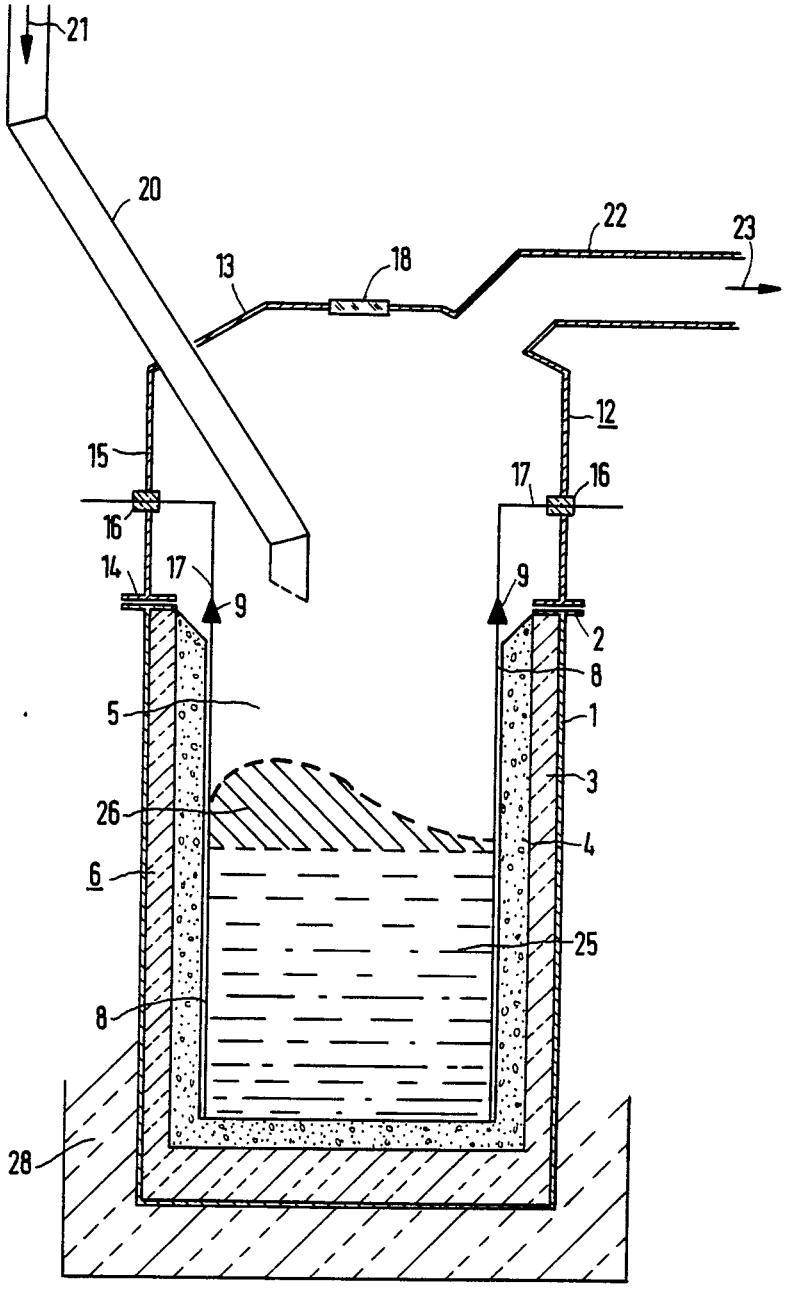
21
20
22
23
13
18
12
15
17
16
16
14
17
9
9
2
8
5
1
3
26
4
6
25
8
28

METHOD FOR CONDITIONING WEAKLY TO MEDIUM-ACTIVE WASTES

BACKGROUND OF THE INVENTION

1. Field of the Invention

The invention relates to a method for conditioning weakly to medium-active wastes by fused vitrification by means of electrodes for generating the melting heat.

2. Description of the Prior Art

The known vitrification methods which, incidentally, are used almost exclusively for conditioning highly active waste, operate with large melting trays from which the melt is poured into small steel molds. The effort required there is relatively large and therefore is economical only if a continuous operation of the plant can be run.

SUMMARY OF THE INVENTION

An object of the invention is to provide a simplified method of fused vitrification which is also suitable for conditioning weakly to medium-active wastes which accumulate in relatively small quantities in a nuclear power station.

With the foregoing and other objects in view, there is provided in accordance with the invention a method for treating weakly to medium radioactive wastes through fused vitrification by means of electric electrodes for generating melting heat to produce a vitreous matrix in which the weakly to medium radioactive wastes are bound, in a container suitable for ultimate storage, which comprises introducing a feed mixture of wastes with vitreous forming materials into a cup-shaped melting crucible in which are disposed at least two electrodes, closing off the open top of the crucible by placing a furnace hood with electric leads connected to an electric source of power, on the crucible, connecting the electric leads to the electrode and applying electric power to melt the feed mixture in the crucible and form a vitreous matrix in which the wastes are bound, removing the hood and disconnecting the electric leads from the electrodes, cooling down the vitreous matrix, and adding an inactive cement paste to the top of the crucible to form a cover layer.

In accordance with the invention, there is provided an apparatus for treating weakly to medium-radioactive wastes through fused vitrification by means of electric electrodes for generating melting heat to produce a vitreous matrix in which the weak to medium radioactive wastes are bound, in a container suitable for ultimate storage, comprising a melting crucible constructed of an outer sheet metal wall with a flange on top and a lining of refractory concrete, at least two spaced electrodes adjacent the refractory lining in the interior of the crucible, connecting means for connecting the electrodes to current leads, a removable furnace hood with a flange at its bottom for mounting on the flange of the crucible, insulators in the hood wall through which current leads connected to an external source of electric power, pass for connection with said connecting means of the electrodes, an inclined feed tube for introducing feed wastes extending through and into the interior of the hood for discharge of the feed wastes into the crucible, a suction line leading from the hood to an exhaust gas system, and a thermal insulating jacket for controlling cooling down after melting, in which the crucible can be inserted and removed.

Other features which are considered as characteristic for the invention are set forth in the appended claims.

Although the invention is illustrated and described herein as embodied in a method for conditioning weakly to medium active wastes, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing which diagrammatically illustrates apparatus for carrying out the method of the invention.

A melting crucible about the size of a 50 gallon barrel stands on end with its top end open. The crucible is constructed of an outer sheet metal wall with a flange on top, a lining of refractory concrete and a layer of thermal insulation interposed between the lining and the metal wall. In the interior of the crucible adacent the refractory lining are spaced electrodes with plug connections at their tops. Above the crucible is disposed a removable furnace hood which has a lower cylindrical section with a flange and an upper dome-like section.

The flange of the hood is placed on top of the flange of the crucible. Insulators are inserted in the hood wall and the current leads passing through them connect by means of the plug connections to the electrodes. An inclined feed tube extends through and into the interior of the hood to a point near the opening of the crucible. A suction line from the hood leads to an exhaust gas system for removal of noxious gases and particles, and also maintains a subatmosphere pressure on the system to prevent escape of gases into the surrounding atmosphere. The dome of the hood is also provided with a viewing glass.

A thermal insulating jacket surrounds the crucible for the purpose of slowing down cooling of the vitreous matrix and thereby preventing cracks in it. The crucible can readily be inserted or removed from the insulating jacket.

DETAILED DESCRIPTION OF THE INVENTION

In accordance with the invention the wastes, optionally with additives, are placed in a cup-shaped melting crucible which contains at least two electrodes. The wastes may be radioactive waste concentrate from a light-water reactor or a borate containing waste from a pressurized-water reactor or concentrates from weakly to medium active liquid wastes containing suspended solids or ash from the combustion of solid wastes or resin waste from ionexchangers. The melting crucible is closed off at the top by a furnace hood which has electric power lead-ins; and voltage is applied via the current leads to the electrodes until the melting crucible is largely filled with melted material. The current leads are disconnected from the electrodes and the furnace hood is removed. The melting crucible is cooled down. Inactive cement paste is added to the crucible to produce a cover layer. The new method does not require large facilities. The apparatus relies to a large extent on the furnace hood which is reused repeatedly for the vitrification. The melting crucibles, however, may be used only once as a vessel in which fusion of the wastes is effected and then serve as ultimate storage containers of the vitreous products incorporating the wastes. The melting crucible can be made relatively inexpensively, for instance of sheet metal which is provided with refractory lining, preferably in the form of a centrifugal casting. The refractory lining can be applied to a layer of temperature-resistant thermal insulating materials, for instance, glass wool or asbestos, i.e. the thermal insulating materials are interposed between the sheet metal and the refractory lining. The refractory lining and the layer of thermal insulating materials combine to produce a lining 50 to 100 mm thick.

After the vitreous material is covered with inactive cement paste, the metal container can additionally be provided with a welded-on lid in order to improve the enclosure of the active material.

The electrodes are preferably made of a metal resistant to high temperature so that they can be connected via a plug-in connection at the current leads of the hood. This facilitates mounting and removing the hood by remote control.

The melting crucible can advantageously be surrounded with an outer insulating jacket to slow down and control the cooling-down process. The insulating jacket may be removable in order to make the cooling-down process variable.

During the melting process, the interior of the furnace hood is advantageously connected to an exhaust gas system. An underpressure i.e. suction or a partial vacuum is produced at least shortly before the furnace hood is removed, to thereby eliminate active gases or air containing dust.

The wastes are advantageously filled into the melting crucible through a tube passing through the furnace hood. A tight enclosure of the active waste is thus obtained, making radioactive polution of the environment practically impossible.

The furnace hood used in carrying out the method of the invention, is characterized by the features of a hood-shaped metal body with a flange which with the crucible flange may be used to form a seal, and which flanges may be insulated from each other by the interposition of an insulating ring; at least two electric insulators are fastened to leads of electric current leads passing through the wall of the metal body to insulate the leads from the metal body; a filling tube passing through the metal body for discharge of feed materials into the melting crucible; and a suction line with its inlet opening at the metal body. The flange can be connected to the melting crucible by a screw connection or similar clamping devices. Tightness of the flange is important because it prevents leakage of the waste and also permits effective suction of the undesired gases from the interior of the hood.

A viewing window for observing the filling and melting process can be inserted into the top side of the hood-shaped metal body.

Preferably, the furnace hood has three symmetrically distributed leads for connection to a three-phase network because it has been found that particularly fast heating-up can be accomplished with three uniformly distributed electrodes.

To explain the invention in greater detail, a melting crucible with furnace hood which is used for the method according to the invention, is described with reference to the attached drawing, shown in a simplified vertical cross section. A melting crucible which also serves as the ultimate storage container has an outer sheet metal wall 1 with about the external dimensions of a 200-liter standard barrel. Thermal insulation 3 resistant to high temperature, such as rock wool or asbestos is applied. On top thereof is a so-called furnace lining 4 of refractory concrete which is applied by a centrifugal casting process. The thickness of the two layers is 100 mm.

In the interior 5 of the melting crucible 6 are three symmetrically distributed electrodes 8 arranged in the vicinity of the furnace lining 4. They consist of heat rresistant steel with a plug-connection 9, at the upper end of each electrode 8 in the vicinity of the flange 2.

In initiating the melting process, a furnace hood 12 is placed on the flange 2 of crucible 6. Furnace hood 12 has a hood-shaped or dome-shaped metal body 13 with a cylindrical lower section or region 15 with a flange 14 at the bottom of section 15 which rests on the flange 2. Three ceramic insulators 16 are arranged in the cylindrical region 15 as the electrical feedthroughs for the current leads 17 which lead to the plug connection 9.

A viewing glass 18 through which the melting process in crucible 6 can be observed is placed in the dome of metal body 13. An inclined tube 20 passes through and is welded to metal body 13. Inclined tube 20 extends from outside metal body 13 where the tube receives feed material and then leads downward through body 13 a distance about parallel with the plane of the flange 14, at which point the feed mixture of radioactive materials and additives to be melted discharges, as is shown by the arrow 21. In addition furnace hood 12 has a suction line 22 connected to an opening body 13. The suction line 22 leads to an exhaust-gas system of conventional design, not shown, and suction is applied to the interior of furnace hood 12, indicated by the arrow 23. The exhaust-gas system may include scrubbing of the gas to prevent the emission of harmful gases, and also particularly the emission of active dust.

The mixture filled through the line 20 into the crucible 6 consists in approximately equal parts, of evaporator concentrate, i.e. of the radioactive waste concentrated by evaporation, which are produced in the cooling water processing in light-water reactors, and of additive material required for vitrification. In pressurized-water reactors, the radioactive wastes are predominantly borates. The waste can furthermore comprise a concentrate which is produced in settling filters for the decontamination of weakly active liquid wastes in which suspended material is contained. Such filter concentrates have a solid content of about 30% by weight. The solid consist predominantly of filtering aids and has a silica content of about 90%, so that thereby, the $SiO_2$ required for the vitrification is available. Ash from the combustion of solid wastes which is provided for volume reduction is suitable for processing according to the invention. Such ashes contain predominantly silicates, carbonates and oxides of alkali metals and oxides of alkaline earth metals.

A further component of the waste which can be treated with the method according to the invention contains resin wastes from ionexchanger filters. These should be pretreated before charging into the melt, preferably by plastification of the moist or dried resins by mixing with clay, dust and water. This plastified matter can be brought into a form suitable for introduction into the melting crucible 6 by extrusion of the plastified matter, preferably after drying of the molded bodies in a continuous process oven at temperatures around 800° C. where the organic resin matrix is burned up. Such dried clay bodies contain practically the entire radioactivity inventory of the resins. The content of $SiO_2$ and $Al_2O_3$ stemming from the clay dust and now incorporated in the dried clay bodies further contributes to the amount of oxide required for the formation of the glass.

The above-mentioned wastes, together with additive materials, for instance silicates in the form of clay dust, quartz-sand and diatomaceous earth either in the form of individual components or after mixing the liquid and the powdered wastes and the additive material, are directed into an intermediate tank. The dosing and the transport of these materials making up the feed mixture to melting crucible 6 can be facilitated by pelletizing, which also makes intermediate storage in silos possible.

The melting operation is initiated by introducing feed mixture through tube 20 into melting crucible 6 in an amount sufficient to fill only a part of crucible 6, say roughly 10–20% of its volumetric capacity. Thereafter heating of the feed mixture in the crucible is effected by applying electric power, for instance 40 kW, through the electrodes 8 to melt the feed mixture and form a glass 25. During the melting, additional feed mixture can be fed in through tube 20 which may be provided with the usual checkvalve means, not shown, for preventing escape of gas from the crucible through the tube. The additional feed mixture falls on top of glass-body 25, as indicated at 26 and also melts and becomes part of body 25. In this manner, the crucible 6 becomes filledup to the region of the flange 2 with a vitreous product incorporating radiactive wastes in a matter of, for instance 8 hours. Thereupon, the crucible is allowed to cool off. Cooling should be conducted to maintain the integrity of the glass body 25, i.e. prevent cracks which may make the body susceptible to disintegration with greater exposure of the radioactive components, particularly by leaching. The cooling off can be controlled by a thermal insulating jacket 28 around the outer wall 1 of crucible 6 to preserve the glass matrix 25 contained within crucible 26 without damage, i.e. without cracks. The cooling off process takes, for instance, about 15 hours. During the heating process, an underpressure or reduced pressure below ambient pressure of 0.01 bar is maintained in the interior of the furnace hood 12, to insure that no radio activity will escape to the outside atmosphere. After the glass matrix has cooled off, the furnace hood is lifted off. In this procedure, the current leads 17 separate from the electrodes 8 and the latter remain in the glass material. The space between the top of the melting crucible is then merely filled up with an inactive cement paste to provide a cover. In addition, a sheet metal plate can be placed on the flange 2 and welded thereto. The melting crucible containing the vitreous body radioactive wastes is now ready for ultimate storage.

The method according to the invention results in weakly to medium active wastes being bound up in a vitreous matrix, which wastes are present in the matrix in the very concentrated form and are resistant to leaching. In this form, the waste bounded matrix material is also easy to transport because it can be handled with lifting devices provided for standard barrels.

The foregoing is a description corresponding to German Application No. P 32 04 204.3 filed Feb. 8, 1982, International priority of which is being claimed for the instant applicaton, and which is hereby made part of this application. Any discrepancies between the foregoing specification and the aforementioned corresponding German application are to be resolved in favor of the latter.

We claim:

1. Method for conditioning radioactive wastes in a crucible for melting the radioactive wastes and which crucible also serves as the final storage container for the wastes vitrified therein, which comprises disposing at least two spaced electrodes to project into the radioactive wastes introduced as feed into the melting crucible, tightly fitting a furnace-hood over the melting crucible, said hood having current leads through the hood connected to an electric source of power, supplying heat for melting the feed wastes in the melting crucible by resistance heating of the wastes by passing the electric current through the electrodes while maintaining reduced pressure in the interior of the furnace hood, adding additional feed to the melt in the crucible while applying electric current to the eletrodes until the crucible is almost completely filled, removing the furnace-hood together with the current leads from the crucible, retaining the electrodes permanently in the vitrified leach-resistant body of wastes in the crucible, cooling the melting crucible and filling the cooled crucible with an inactive cement paste.

2. Method according to claim 1, wherein the melting crucible is a metal container with a refractory lining.

3. Method according to claim 2, wherein the lining is made as a centrifugal casting.

4. Method according to claim 2, wherein a layer of temperature-resistant thermal insulating materials is interposed between the lining and the metal container.

5. Method according to claim 1, wherein a metal lid is welded on the metal container.

6. Method according to claim 2, wherein a metal lid is welded on the metal container.

7. Method according to claim 4, wherein a metal lid is welded on the metal container.

8. Method according to claim 1, wherein the electrodes are of highly temperature resistant metal, and wherein the electrodes are connected to the current leads via a plug-in connection.

9. Method according to claim 1, wherein the cooling-down time is controlled by an outer insulating jacket surrounding the melting crucible.

10. Method according to claim 1, wherein reduced pressure is maintained in the interior of the furnace hood during the melting process by applying suction through an opening in the furnace hood.

11. Method according to claim 1, wherein the feed mixture is introduced into the melting crucible through a tube which passes from a point outside the furnace hood through an opening in the hood and then into the interior of the hood.

12. Method according to claim 1, wherein the hood-shaped body is made of metal and has a flange for tightly mounting it onto the melting crucible, and wherein electric insulating bodies are inserted in the wall of the metal body, to insulate the electric leads from the metal wall.

13. Method according to claim 12, wherein visibility of the melting process in the crucible is obtained by a viewing glass in the top side of the hood-shaped metal body.

14. Method according to claim 10, wherein three symmetrically distributed electric leads are provided for connection to a three-phase electric network.

* * * * *